US006941701B2

(12) United States Patent
Inage

(10) Patent No.: US 6,941,701 B2
(45) Date of Patent: Sep. 13, 2005

(54) SIDE SLIDING DOOR DEVICE FOR VEHICLE

(75) Inventor: Akio Inage, Mie (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 0 days.

(21) Appl. No.: 10/653,922

(22) Filed: Sep. 4, 2003

(65) Prior Publication Data

US 2004/0211121 A1 Oct. 28, 2004

(30) Foreign Application Priority Data

Apr. 23, 2003 (JP) ..... 2003-118368

(51) Int. Cl.[7] ..... E05F 1/00; E05F 11/02
(52) U.S. Cl. ..... 49/449; 49/279; 49/280
(58) Field of Search ..... 49/449, 116, 118, 49/279, 280, 300, 304; 292/DIG. 46, DIG. 23, 144, 146, 163, 164, 341.15, 341.16

(56) References Cited

U.S. PATENT DOCUMENTS

| | | | | | |
|---|---|---|---|---|---|
| 1,976,223 | A | | 10/1934 | Hedley et al. | |
| 3,745,705 | A | * | 7/1973 | Reddy | 49/139 |
| 4,153,826 | A | | 5/1979 | Reddy | |
| 4,882,876 | A | | 11/1989 | Daugirdas | |
| 5,460,100 | A | | 10/1995 | Gowda et al. | |
| 5,755,060 | A | | 5/1998 | Zweili | |
| 5,894,911 | A | * | 4/1999 | Bozorgzadeh et al. | 49/116 |
| 5,927,015 | A | | 7/1999 | Ghosn et al. | |
| 6,009,668 | A | * | 1/2000 | Reddy | 49/280 |
| 6,446,389 | B1 | | 9/2002 | Heffner et al. | |
| 6,662,500 | B2 | * | 12/2003 | Inage | 49/116 |
| 6,688,042 | B2 | * | 2/2004 | Stojc et al. | 49/118 |
| 6,712,406 | B2 | * | 3/2004 | Stojc | 292/DIG. 46 |
| 6,739,092 | B2 | * | 5/2004 | Heffner et al. | 49/280 |
| 2003/0126797 | A1 | | 7/2003 | Inage | |

FOREIGN PATENT DOCUMENTS

| | | |
|---|---|---|
| JP | 2000-142392 | 5/2000 |
| JP | 2002-357052 | 12/2002 |

* cited by examiner

*Primary Examiner*—Hugh B. Thompson, II
(74) *Attorney, Agent, or Firm*—Venable LLP; Michael A. Sartori; Catherine M. Voorhees

(57) ABSTRACT

A side sliding door device is provided for a vehicle that opens and closes an entrance on a side of the vehicle by a sliding door movably supported on a horizontal door rail. The sliding door device includes an automatic locking mechanism that is interlocked with a closing operation of the sliding door, and locks the sliding door in a closed state, and a manual locking mechanism that locks the sliding door in the closed state by a manual operation. The automatic locking mechanism and the manual locking mechanism are secured on a common base plate on a vehicle body and integrated into one unit, so that the manual locking mechanism prevents an unlocking operation of the automatic locking mechanism in a locked state and holds the sliding door in the locked state.

5 Claims, 7 Drawing Sheets

SIDE SLIDING DOOR DEVICE FOR VEHICLE

This application claims priority from Japanese Patent Application No. 2003-118368 filed Apr. 23, 2003, which is incorporated hereinto by reference.

BACKGROUND OF THE INVENTION

1. Field of the Invention

The present invention relates to a side sliding door device that opens and closes an entrance or opening on a side of a railway vehicle, for example, a train, and more particularly to a locking mechanism that locks a sliding door in a closed state.

2. Background of the Invention

Side sliding door devices for a train fulfill an important role in protecting passengers' lives, and must not be freely operated regardless of whether the train is moving or not, and require high operational reliability. In general, a side sliding door device has a sliding door driven by an actuator at each entrance. The sliding door is automatically locked in a closed state by an automatic locking mechanism when a closing operation is completed, and unlocked by an electric actuator, for example, an electromagnetic actuator, operated according to a sliding door opening instruction when an opening operation is performed.

If a problem trouble occurs in an opening/closing instruction system while the sliding door is operated, and, for example, the sliding door does not perform the opening operation even if the opening instruction is provided, the automatically locked sliding door is likely to be unlocked by an operational error of the electric actuator. For such abnormal conditions as this, a manual locking mechanism is separately provided. The manual locking mechanism mechanically locks the sliding door by a manual operation in the abnormal conditions, and avoids the risk of unlocking even if any electrical problems occur.

FIGS. 10 to 13 show a prior art example of the manual locking mechanism. FIG. 10 is a front view thereof in an unlocked state, FIG. 11 is a partial sectional view taken along the line XI—XI in FIG. 10, FIG. 12 is a front view thereof in a locked state, and FIG. 13 is a partial sectional view taken along the line XIII—XIII in FIG. 12. In FIGS. 10 to 13, a manual locking mechanism 50 has a manual rotary (cylinder) lock 51 and a lock lever 52 integrally secured to a rotation axis thereof, and is secured to a column 54 on a side of an entrance of a train vehicle body via a fastener 53 having a horseshoe-shaped section. The manual locking mechanism 50 is placed, for each door of the double sliding doors 1, 2 (the manual locking mechanism 50 for the sliding door 2 only is shown), adjacent to a back end surface of each of the sliding doors 1, 2 shown in a closed state.

In FIGS. 10 and 11, the lock lever 52 is in an upright state, and does not prevent an opening operation of the sliding door 2 to the right. FIGS. 12 and 13 show a state in which the rotary lock 51 is rotated through 90° by an unshown key inserted from a keyhole in the left end surface as shown in the drawings. The lock lever 52 protrudes behind the rear end surface of the sliding door 2. In this state, the sliding door 2 is held by the lock lever 52, and cannot perform the opening operation from the shown closed state. In FIG. 13, reference numeral 55 denotes a back-up block for the lock lever 52 which is secured to a column 56 of the vehicle body. As described above, the manual locking mechanism 50 is manually operated by a conductor in abnormal conditions to lock the sliding door 2 in the closed state by the lock lever 52. The locking is mechanically performed to prevent the possibility of unlocking caused by an electrical problem.

However, the prior art has a structure in which movement of the sliding door is restricted by the manual locking mechanism mounted to the vehicle body. Thus, manufacturing errors of the sliding door influence mounting positions of the manual locking mechanism. As a result, it takes substantial time to perform positional adjustment of the manual locking mechanism for each sliding door at the site where the vehicle is used. For example, if two sliding doors are placed at each of four entrances on one side, one vehicle includes 16 sliding doors, and the adjustment operation requires a large number of steps.

SUMMARY OF THE INVENTION

Therefore, an object of the invention is to eliminate the need for adjustment of a manual locking mechanism provided in a side sliding door device for a vehicle at the site where the vehicle is used, and to reduce the number of steps for assembling the vehicle.

In order to achieve the above described object, a side sliding door device for a vehicle according to an embodiment of the invention There is provided a side sliding door device for a vehicle that opens and closes an entrance on a side of the vehicle by a sliding door movably supported on a horizontal door rail, comprising:

an automatic locking mechanism interlocked with a closing operation of the sliding door to lock the sliding door in a closed state; and a manual locking mechanism that locks the sliding door in the closed state by a manual operation, wherein the manual locking mechanism prevents an unlocking operation of the automatic locking mechanism when the door is in a locked state, and holds the sliding door in the locked state.

Here, the automatic locking mechanism and the manual locking mechanism may be provided on a common base plate on a vehicle body and integrated in a single unit.

The manual locking mechanism may comprise a switch connected with the manual operation, the switch turning off power of an actuator that drives the sliding door when the sliding door is manually locked by the manual locking mechanism.

The automatic locking mechanism may comprise:

a latch mechanism including a latch bar movably supported in a vertical direction with respect to the vehicle body, and a latch hole provided on the sliding door to receive the latch bar;

unlatching means for releasing a latched state of the latch mechanism; and latch holding means for holding an unlatched state of the latch mechanism.

The manual locking mechanism may comprise:

a rotary lock; and a lock lever secured to a rotational shaft of the rotary lock, and when the rotary lock is rotated by a manual operation, the lock lever engages with a lock fastener integral with the latch bar.

According to the invention, the manual locking mechanism does not directly hold the sliding door, but prevents the unlocking operation of the automatic locking mechanism. Thus, a positional relationship between the automatic locking mechanism and the manual locking mechanism can be adjusted in a factory, and the mechanisms are both mechanical parts with high dimensional accuracy and can be easily adjusted.

The positional relationship between the automatic locking mechanism and the manual locking mechanism can be maintained more accurately, and handling at the site where the mechanisms are mounted to the vehicle is further simplified.

Mechanical locking of the sliding door prevents an operation of the actuator at the same time, thus further increasing safety.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
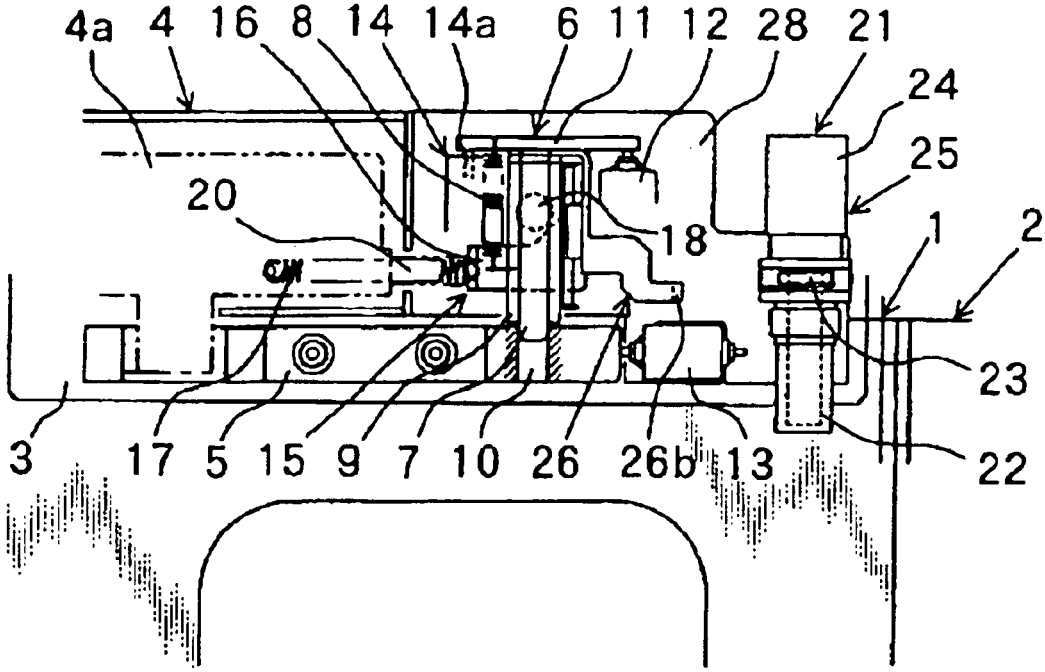
FIG. 1 is a front view of a preferred embodiment of a side sliding door device according to the invention, in which an automatic locking mechanism is in a locked state, and a manual locking mechanism is in an unlocked state.
Figure 2:
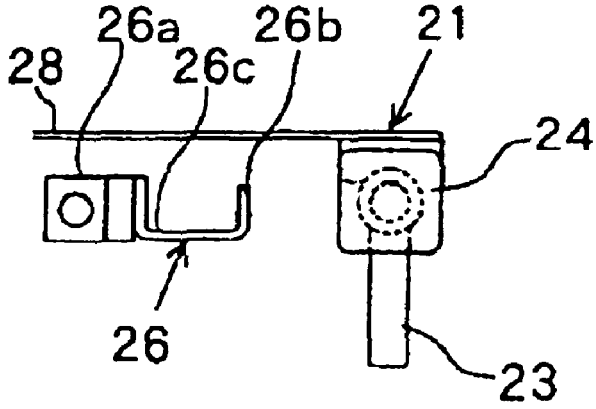
FIG. 2 is a plan view of the manual locking mechanism in FIG. 1.
Figure 3:
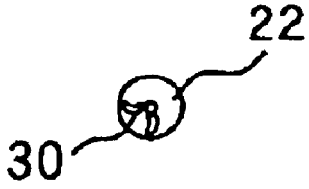
FIG. 3 is a bottom view of a rotary (cylinder) lock in FIG. 2.
Figure 4:
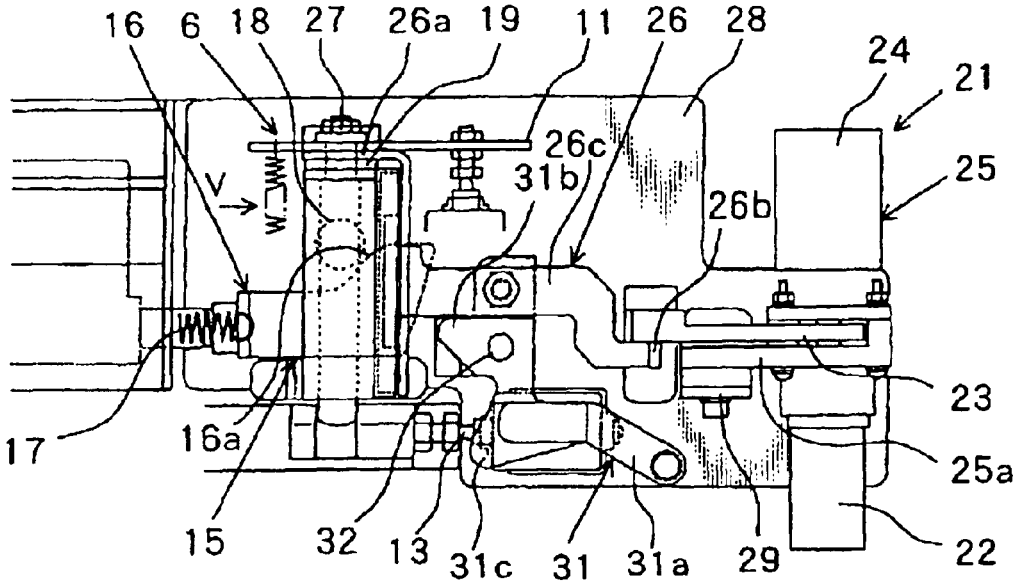
FIG. 4 is an enlarged view of the locking mechanism in FIG. 1.
Figure 5:
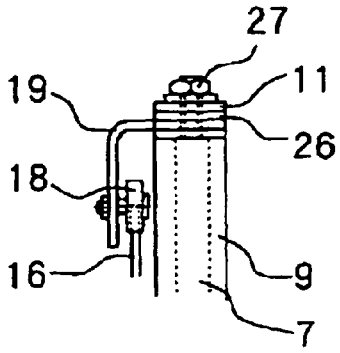
FIG. 5 is a partial side view taken in the direction of arrow V in FIG. 4.

FIGS. 1 to 9 show a preferred embodiment of the invention. FIG. 1 is a front view of essential portions of a side sliding door device, in which an automatic locking mechanism is in a locked state, and a manual locking mechanism is in an unlocked state, FIG. 2 is a plan view of the manual locking mechanism in FIG. 1, FIG. 3 is also a bottom view of a rotary lock, FIG. 4 is an enlarged view of essential portions in FIG. 1, and FIG. 5 is a partial side view taken in the direction of arrow V in FIG. 4.

In FIG. 1, two sliding doors 1, 2 are movably hung and supported on an unshown door rail, which is horizontally mounted along a side surface of a vehicle, via a hanger 3, and move in laterally opposite directions in FIG. 1 to open and close an entrance of a train. A linear motor 4 as an actuator that opens and closes the sliding doors 1, 2, a locking mechanism that locks the sliding doors 1, 2 into a closed state, and an unlocking mechanism that unlocks the locking mechanism are independently provided on each of the two sliding doors 1, 2 (only the linear motor 4 or the like for the left sliding door 1 are shown in FIG. 1). Thus, even if one linear motor 4 of either of the sliding doors 1, 2 goes out of order, the other linear motor 4 of a separate system can open and close one of the sliding doors 1, 2. Now, description will be made with respect to the sliding door 1, but a configuration and an operation of each part also applies to the sliding door 2.

In FIG. 1, a latch bracket 5 is secured by bolts to a hanger 3 integral with the sliding door 1, and a movable part 4*a* of the linear motor 4 is connected to the latch bracket 5. In the closed state in FIG. 1, the sliding door 1 is locked by an automatic locking mechanism 6. The automatic locking mechanism 6 includes a latch bar 7 that is guided by a guide cylinder 9 having a hollow prism shape, secured to a base plate 28 on the vehicle body, and is provided slidably in a vertical direction. A locking spring 8 in the form of a tension coil spring urges the latch bar 7 toward the sliding door. The latch bar 7 is constituted by a round bar, and is guided by the hollow prism shape guide tube 9 to be inserted into a latch hole 10 provided in the latch bracket 5. A latch plate 11 is attached to a head of the latch bar 7, and the locking spring 8 under tension is positioned between the latch plate 11 and the guide tube 9. The latch bar 7 is received in the latch hole 10 and then connected to the latch bracket 5, when a closing operation of the sliding door 1 is completed, so as to lock the sliding door 1 in the closed state.

Reference numeral 12 denotes a locking switch (limit switch), which is secured to the base plate 28 on the vehicle body. The locking switch is actuated by the latch plate 11 in the shown locked state to be turned on, and sends a locking signal to a controller. Reference numeral 13 denotes a similar door closing switch, which is actuated by the latch bracket 5 in the shown closed state to be turned on, and sends a door closing signal to the controller. A solenoid 14 is provided as a drive source of the unlocking mechanism that drives the latch bar 7 against the locking spring 8. The solenoid 14 is vertically secured to the vehicle body, and a plunger 14*a* thereof is at a lower end of a stroke in the shown OFF state, and adjacent to a lower surface of the latch plate 11.

In FIGS. 1 and 4, unlocking holding means 15 is provided in order to hold the latch bar 7 out of engagement with the latch bracket 5. The unlocking holding means 15 includes, as described later, a slider 16 as a holding member that holds the latch bar 7 out of engagement with the latch bracket 5, and a tension coil return spring 17 that urges the slider 16 to the left in FIG. 1. The slider 16 is slidably supported on the vehicle body in a lateral direction in FIG. 1, and, as described later, pushes up a roller 18 integral with the latch bar 7 via a slope of a cam surface 16*a* (FIG. 4) in the unlocked state, and prevents movement of the latch bar 7 into the latch hole 10. The roller 18 is rotatably supported on a mounting plate 19 having an inverted L-shape secured to the head of the latch bar 7 as shown in FIG. 5.

The return spring 17 is connected, at one end, on the slider 16, and at the other end, on the vehicle body. Thus, in the closed state of the sliding door 1 in FIG. 1, the slider 16 is pushed to the right by a push rod 20 mounted to an end of the movable part 4*a*, the cam surface 16*a* is disengaged from the roller 18, and the return spring 17 is extended. The unlocking operation of the automatic locking mechanism 6 will be described later.

A basic structure of the locking mechanism is also disclosed in co-pending U.S. patent application Ser. No. 10/155,243 filed May 28, 2002, assigned to the same assignee as this application, the content of which is incorporated by reference.

Next, in FIGS. 1 and 4, reference numeral 21 denotes a manual locking mechanism. The manual locking mechanism 21 includes a lock unit 25 includes a rotary lock 22, a lock lever 23 secured to a rotational shaft of the rotary lock 22 and a rotary switch 24 interlocked with the rotary lock 22, and a lock fastener 26 with which the lock lever 23 engages. The lock fastener 26 is formed by bending a steel plate into the shown shape, and has a left L-shaped bent portion 26*a*, a right lateral engagement portion 26*b*, and a central portion 26*c* connecting the left and right portions. The lock fastener 26 is, as shown in FIG. 4, integrally secured to the head of the latch bar 7 via an upper portion of the L-shaped bent portion 26*a*. Thus, as shown in FIGS. 4 and 5, the latch plate 11, the mounting plate 19, and the lock fastener 26 fit into a screw portion integrally formed on the head of the latch bar 7, and fastened in common by a nut 27.

The guide tube 9 of the automatic locking mechanism 6 that guides the latch bar 7, the locking switch 12, the door closing switch 13, the solenoid 14, the slider 16, or the like are provided on a steel base plate 28. The lock unit 25 of the manual locking mechanism 21 is also secured on the base plate 28, via an arm 25*a* thereof and an L-shaped support fastener 29 (FIG. 4). That is, the automatic locking mechanism 6 and the manual locking mechanism 21 are integrated into one unit by the base plate 28, and the locking unit is secured to the train vehicle body integrally with the linear motor 4.

Figure 6:
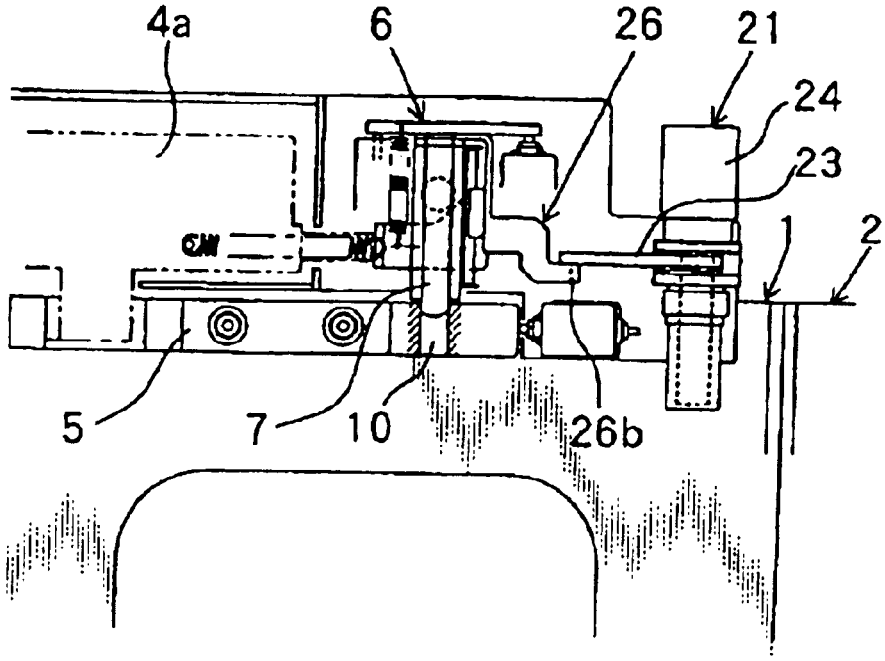
FIG. 6 is a front view of the preferred embodiment of the side sliding door device according to the invention, in which the automatic locking mechanism and the manual locking mechanism are both in locked states.
Figure 7:
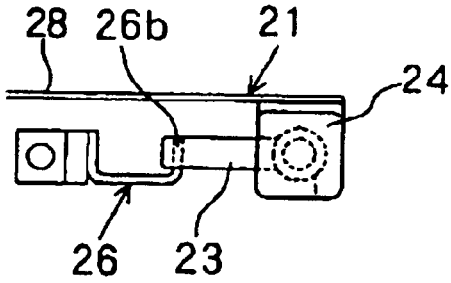
FIG. 7 is a plan view of the manual locking mechanism in FIG. 6.

In FIG. 1, when an abnormal condition occurs in an opening/closing instruction system of the sliding door 1, an unshown key is inserted into a keyhole 30 in a bottom surface of the rotary lock 22 as shown in FIG. 3 to rotate the key clockwise in FIG. 2. Then, the lock lever 23 rotates through 90° to overlap a top surface of the laterally bent engagement portion 26*b* at a tip of the lock fastener 26. FIG. 6 is a front view of a manually locked state, and FIG. 7 is a plan view of the manual locking mechanism in the state shown in FIG. 4. For the automatic locking mechanism 6 in FIG. 6, the latch bar 7 fits into the latch hole 10 of the latch bracket 5 to lock the sliding door 1.

To unlock the automatic locking mechanism 6, as described later, it is necessary to draw the latch bar 7 from the latch hole 10 and disengage the latch bar 7 from the latch bracket 5. However, in the manually locked state in FIG. 6, upward movement of the latch bar 7 is prevented by the lock fastener 26 with which the lock lever 23 engages. Thus the sliding door 1 is held in the locked state. Specifically, in FIG. 6, the manual locking mechanism 21 prevents the unlocking operation of the automatic locking mechanism 6 so as to hold the sliding door 1 in the locked state. In the locked state of the manual locking mechanism 21 in FIG. 6, the rotary switch 24 is interlocked with the rotary lock 22 to switch a contact thereof, and to turn off power of the linear motor 4.

Figure 8:
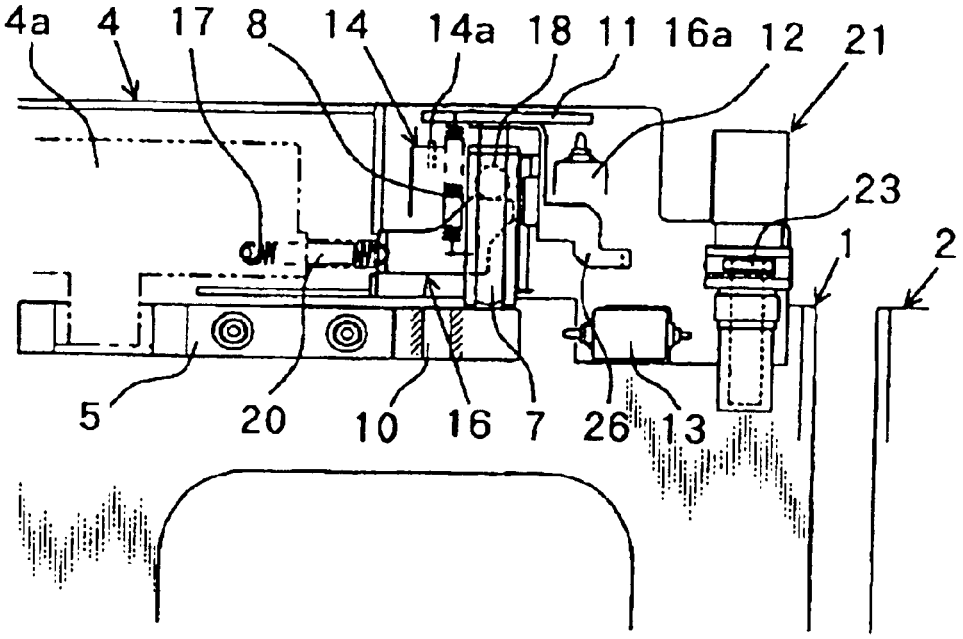
FIG. 8 is a front view of the preferred embodiment of the side sliding door device according to the invention, and shows an unlocking operation state of the automatic locking mechanism.
Figure 9:
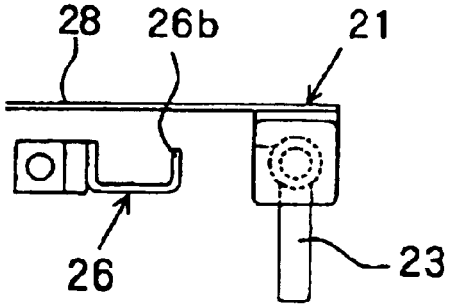
FIG. 9 is a plan view of the manual locking mechanism in FIG. 8.
Figure 10:
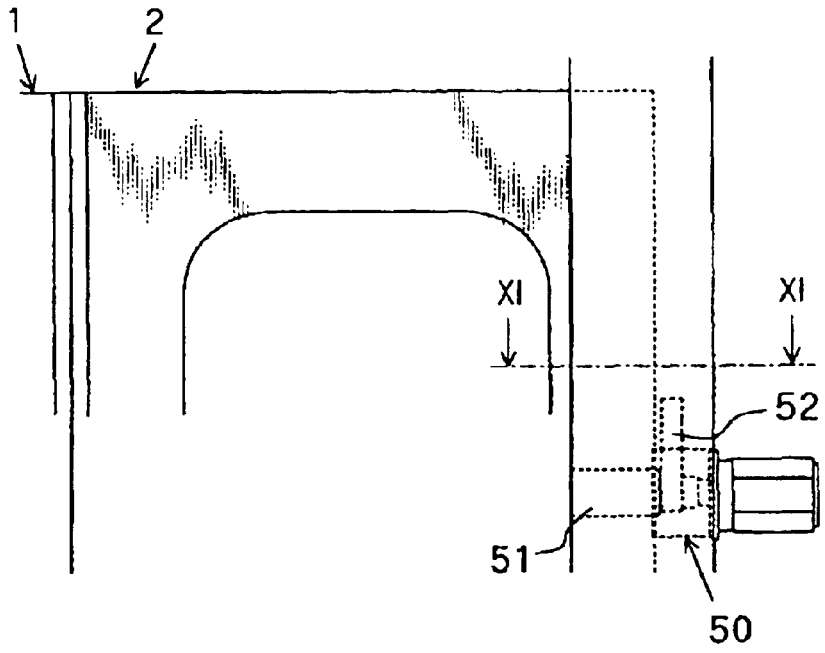
FIG.10 PRIOR ART
FIG. 10 is a front view of an unlocked state of a prior art manual locking mechanism.
Figure 11:
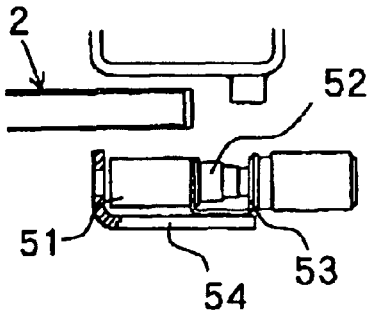
FIG.11 PRIOR ART
FIG. 11 is a plan view of the manual locking mechanism in FIG. 10.
Figure 12:
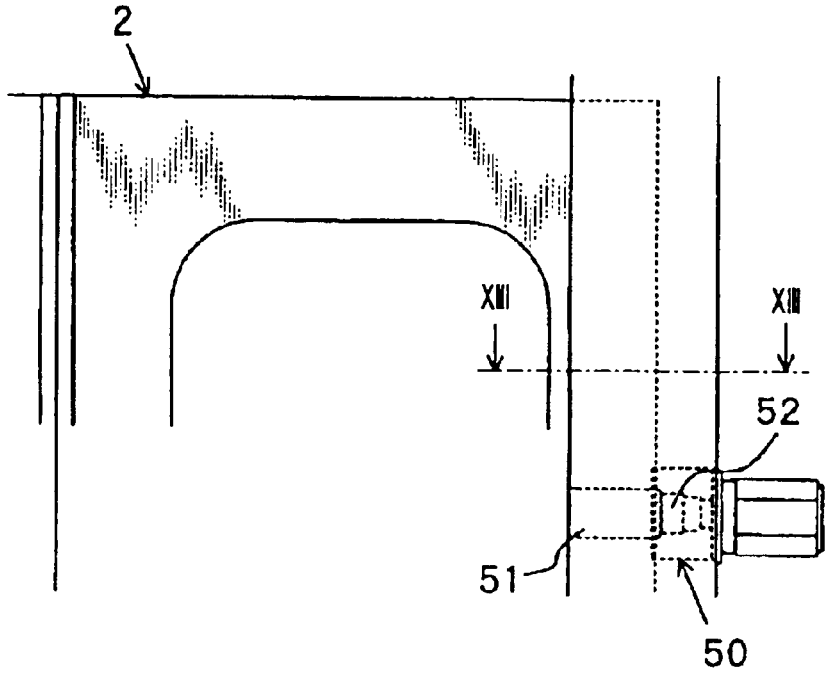
FIG.12 PRIOR ART
FIG. 12 is a front view of a locked state of the manual locking mechanism in FIG. 10.
Figure 13:
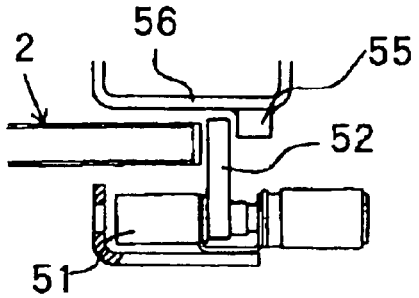
FIG.13 PRIOR ART
FIG. 13 is a plan view of the manual locking mechanism in FIG. 12.

FIG. 8 is a front view of a state where the automatic locking mechanism 6 is unlocked to start the opening operation of the sliding door 1 in FIG. 1, in which the manual locking mechanism 21 is unlocked, and FIG. 9 is a plan view of the manual locking mechanism 21 in FIG. 8. Now, the unlocking of the automatic locking mechanism 6 and the opening operation of the sliding door 1 will be described. When an opening instruction is provided to the mechanism in the closed state in FIG. 1, the solenoid 14 is turned on, and the plunger 14*a* is attracted so as to move upward. The plunger 14*a* raises the latch bar 7 via the latch plate 11 and draws the latch bar 7 out of the latch hole 10. Thus, the latch bar 7 is disengaged from the latch bracket 5, and an opening restriction on the sliding door 1 is removed. At this time, the locking switch 12 is turned off to send an unlocking signal to the controller. The locking spring 8 is extended to apply a downward restoring force to the latch bar 7.

When the unlocking signal is sent from the locking switch 12, the linear motor 4 is turned on after a predetermined time delay, and the movable part 4*a* starts moving to the left in FIG. 6. At this time, the door closing switch 13 is turned off and sends an opening signal to the controller. FIG. 8 shows a point at which the movable part 4*a* slightly moves and the sliding doors 1, 2 are slightly opened. When the movable part 4*a* moves, the slider 16 having been moved by the push rod 20 moves in the same direction as the movable part 4*a* by a restoring force of the return spring 17, and the cam surface 16*a* is positioned below the roller 18. Then, the sliding door 1 is fully opened and stops, and a flat portion of the cam surface 16*a* is placed immediately below the roller 18. In this state, the slider 16 abuts against a front surface of a housing of the linear motor 4 and no longer moves.

On the other hand, when the opening signal is sent from the door closing switch 13, the solenoid 14 is turned off after a predetermined time delay. Then, the latch bar 7 having been raised via the latch plate 11 by the plunger 14*a* starts moving downward by the restoring force of the locking spring 8, but stops at the point where the roller 18 abuts against the flat portion of the cam surface 16*a*, so that the unlocked state is maintained. In this opening operation, the locking operation of the manual locking mechanism 21 is not performed, and the lock lever 23 is placed 90° backward from the lock fastener 26, so that movement of the latch bar 7 is not prevented by the lock lever 23, and the unlocking operation of the automatic locking mechanism 6 can be performed.

Now, the locking operation of the automatic locking mechanism 6 will be described with reference to FIG. 6, which shows a midway condition of the closing operation. When the closing instruction is provided in the opened state, the movable part 4*a* moves to the right in FIG. 6, and then the push rod 20 abuts against the slider 16. If the movable part 4*a* further moves to the right from this point, the slider 16 is pushed by the push rod 20 to move to the right, and the cam surface 16*a* is disengaged from the roller 18. Thus, support for the latch bar 7 is removed the restoring force of the locking spring 8 is applied to the latch bar 7 to move downwardly, and a tip end of the latch bar 7 abuts against the latch bracket 5. The latch bar 7 slides on an upper surface of the latch bracket 5 as the latch bracket 5 moves to the right, and is received in the latch hole 10 to lock the sliding door 1. Therefore, the side sliding door device reenters the locked state shown in FIG. 1.

In FIG. 4, reference numeral 31 denotes an emergency handle. The emergency handle 31 is rotatably supported on the base plate 28 via a support stem 32, and has a grip portion 31*a* and two cam portions 31*b*, 31*c*. In FIG. 4, the manual locking mechanism 21 is in the locked state, but if the emergency handle 31 is rotated clockwise with the grip portion 31*a* in the unlocked state of the manual locking mechanism 21, the cam portion 31*b* pushes up the lock fastener 26, and draws the latch bar 7 out of the latch hole 10 to allow the sliding door 1 to be manually opened. At the same time, the cam portion 31*c* forces the sliding door 1 to the left to create a gap between the sliding doors 1 and 2 (see FIG. 1). This allows the unlocked state to be confirmed visually, where the sliding door 1 can be manually opened and allows the sliding door 1 to be opened by inserting a hand into the gap between the doors.

The manual locking mechanism 21 according to the above embodiment causes the lock lever 23 to engage with the lock fastener 26 integrally secured to the latch bar 7, and forces the latch bar 7 into engagement with the latch bracket 5 to hold the sliding door 1 in the locked state. The positional adjustment of the manual locking mechanism 21 may be performed with respect to the automatic locking mechanism 6 only, and the adjustment operation is easy because it can be performed in a factory as part of the connection of mechanical parts with each other. Therefore, an accurate mounting operation can be performed in a shorter time compared to the prior art in which the positional adjustment is performed with respect to the sliding door at the site where the vehicle is used. In particular, according to the shown embodiment, the automatic locking mechanism 6 and the manual locking mechanism 21 are secured on the common base plate 28 and integrated into one unit, thus the positional relationship therebetween can be maintained more accurately.

Assembly of the hanger 3 that hangs and supports the sliding door 1 on the rail via wheels and the latch bracket 5 is also performed in the factory. Thus, the positional adjustment between the latch bracket 5 and the latch bar 7 can be performed in the factory. As a result, only the hanger 3 and the sliding door 1 may be connected at the site where the vehicle is used, and there is no need for the positional adjustment of the automatic locking mechanism 6 and the manual locking mechanism 21 at the site where the vehicle is used. Further, the manual locking mechanism 21 that locks the sliding door 1 via the automatic locking mechanism 6 does not require such strength as required in direct locking of the sliding door 1, thus allowing reduction in size.

As described above, according to the invention, the manual locking mechanism is configured so as to manually lock the sliding door via the automatic locking mechanism. Thus, the need for the positional adjustment operation at the site where the vehicle is used is eliminated, significantly reducing the number of steps for assembling the vehicle, and increasing the assembly accuracy to increase reliability of the locking operation.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A side sliding door device for a vehicle that opens and closes an entrance on a side of the vehicle by a sliding door movably supported on a horizontal door rail, comprising:

an automatic locking mechanism to be interlocked with a closing operation of the sliding door to lock the sliding door in a closed state; and a manual locking mechanism for locking the sliding door in the closed state by a manual operation, wherein said manual locking mechanism prevents an unlocking operation of said automatic locking mechanism when the sliding door is in a locked state, and holds the sliding door in the locked state.

2. The side sliding door device for a vehicle as claimed in claim 1, wherein said automatic locking mechanism and said manual locking mechanism are adapted to be provided on a common base plate on a vehicle body and integrated in a single unit.

3. The side sliding door device for a vehicle as claimed in claim 2, wherein said automatic locking mechanism comprises:

a latch mechanism including a latch bar movably supported in a vertical direction with respect to the vehicle body, and a latch hole adapted to be provided on the sliding door to receive said latch bar;

unlatching means for releasing a latched state of said latch mechanism; and latch holding means for holding an unlatched state of said latch mechanism.

4. The side sliding door device for a vehicle as claimed in claim 3, wherein said manual locking mechanism comprises:

a rotary lock; and a lock lever secured to a rotational shaft of said rotary lock, and wherein when said rotary lock is rotated by a manual operation, said lock lever engages with a lock fastener integral with said latch bar.

5. The side sliding door device for a vehicle as claimed in claim 1, wherein said manual locking mechanism comprises a switch connected with the manual operation, the switch turning off power of an actuator for driving the sliding door when the sliding door is manually locked by said manual locking mechanism.

* * * * *